US006393704B1

(12) United States Patent
Tompkins et al.

(10) Patent No.: US 6,393,704 B1
(45) Date of Patent: May 28, 2002

(54) SELF-LEVELING EATING UTENSIL

(76) Inventors: David Tompkins, 1700 Dale St., Morgan City, LA (US) 70380; Gerard D. Byrne, Jr., 514 Tournament Ave., Berwick, LA (US) 70342

( * ) Notice: Subject to any disclaimer, the term of this patent is extended or adjusted under 35 U.S.C. 154(b) by 0 days.

(21) Appl. No.: 09/564,676

(22) Filed: May 4, 2000

(51) Int. Cl.[7] ..... A47G 21/04; A47J 43/28
(52) U.S. Cl. ..... 30/324; 30/342; 30/340
(58) Field of Search ..... 30/324, 340, 322, 30/342, 344; 16/DIG. 18, DIG. 19; D7/653

(56) References Cited

U.S. PATENT DOCUMENTS

| | | | | | |
|---|---|---|---|---|---|
| 1,128,190 | A | * | 2/1915 | Routery | 30/327 |
| 1,347,307 | A | * | 7/1920 | Thomas | 30/1 |
| 1,354,709 | A | * | 10/1920 | Williams | 30/169 |
| D90,906 | S | * | 10/1933 | Baker, Jr. | 30/327 |
| 1,997,131 | A | | 4/1935 | Champlin | 30/9 |
| 2,503,643 | A | * | 4/1950 | Verbrugge | |
| 2,571,264 | A | | 10/1951 | Legarra | 259/144 |
| 2,636,266 | A | | 4/1953 | Sweet | 30/324 |
| 2,682,705 | A | * | 7/1954 | Johnson | |
| 2,724,894 | A | * | 11/1955 | Tour | 30/324 |
| 2,741,027 | A | * | 4/1956 | Margolin | |
| 2,809,426 | A | | 10/1957 | Pickering | 30/324 |
| 3,259,132 | A | | 7/1966 | Katter | 128/344 |
| 3,266,081 | A | | 8/1966 | Heim | 16/110 |
| 4,028,803 | A | * | 6/1977 | Currie | |
| 4,389,777 | A | | 6/1983 | Landsberger | 30/324 |
| 4,877,609 | A | * | 10/1989 | Beck et al. | 206/525 |
| 4,993,156 | A | | 2/1991 | Craven | 30/142 |
| 5,603,163 | A | | 2/1997 | Ikner, Jr. | 30/324 |
| 5,890,223 | A | | 4/1999 | Klemmer | 30/150 |
| 6,145,204 | A | * | 11/2000 | Cash | 30/322 |

FOREIGN PATENT DOCUMENTS

| | | | |
|---|---|---|---|
| DE | 2005 351 | | 8/1971 |
| GB | 833889 | | 5/1960 |
| GB | 2214059 | * | 8/1989 |

* cited by examiner

*Primary Examiner*—Allan N Shoap
*Assistant Examiner*—Thomas J. Druan, Jr.
(74) *Attorney, Agent, or Firm*—Pennie & Edmonds LLP

(57) ABSTRACT

A self-leveling eating utensil having a handle and a food carrier rotatably coupled to the handle. The food carrier may be coupled to a shank which is, in turn, rotatably coupled to the handle. The food carrier is positioned offset from the handle and the shank to weight itself into a self-leveling position with the food-carrying surface thereof positioned to carry food without spillage. A weight is preferably provided on the shank to further weight the food carrier into the self-leveling position. The weight may be formed at the free end of the shank opposite the food carrier. In a preferred embodiment, the weight is formed as a bend in the free end of the shank in a direction toward the food carrier. Preferably, the handle is formed to permit decoupling to clean the interior thereof and recoupling to use the eating utensil once again after cleaning. Such handle is formed from first and second handle halves which are readily coupled, decoupled, and recoupled. In a preferred embodiment, the handle halves are directly coupled together at at least first ends which engage each other directly for coupling together. The second ends of the handle halves may be coupled together either directly or with the assistance of a separate coupling element, such as an end cap fitted over the second ends.

17 Claims, 1 Drawing Sheet

SELF-LEVELING EATING UTENSIL

FIELD OF THE INVENTION

The present invention relates to improvements to an eating utensil for individuals with limited manual dexterity. More particularly, the present invention relates to improvements to self-leveling eating utensils.

BACKGROUND OF THE INVENTION

A variety of improvements to eating utensils have been made in order to facilitate use by individuals with limited dexterity, such as babies, the elderly, and the disabled. Improvements typically relate to the handle, such as formation of the handle in an ergonomically correct configuration to facilitate grasping. Thus, a variety of eating utensils with widened, curved, or cushioned handles are known in the art.

Another improvement known in the art is the provision of a food-engaging portion of the eating utensil which is self-leveling. Typically, such self-leveling is effected by permitting the food-engaging portion to rotate with respect to the handle of the eating utensil. An example of such a rotating food-engaging portion is shown in U.S. Pat. No. 5,603,163 to Ikner, Jr. ("the Ikner patent") in which the stem of the eating utensil is rotatably disposed within a molded handle. A flange on the stem is rotatably entrapped within the handle to secure the handle and stem together. The food carrier portion is angled from the stem to weight the food carrier portion into the leveled position. However, the food carrier portion extends a significant distance away from the handle and there is no counterbalancing weight along any other portion of the stem. Accordingly, the stem may stick against the interior passage of the handle in which the stem is positioned. Such a concept of sticking may be appreciated with reference to U.S. Pat. No. 2,636,266 to Sweet ("the Sweet patent") in which sticking is intentional (to prevent rotation of the spoon) and even enhanced by the provision of a bent end of the eating utensil stem for engagement with a spline on the interior of the handle.

One feature of the rotatable spoon of the Sweet patent not provided in the swivel spoon of the Ikner patent is the formation of the handle to permit cleaning. It is noted that U.S. Pat. No. 4,389,777 to Landsberger also shows an eating utensil handle capable of being cleaned. In this eating utensil, the handle is formed from separable halves held together by a removable end cap at each end. However, this design is complicated to manufacture, and complicated to disassemble for ready cleaning and to reassemble for ready reuse.

It therefore is desirable to provide a self-leveling eating utensil which is easy to manufacture, use, and clean, and which overcomes the disadvantages of the above-described eating utensils.

SUMMARY OF THE INVENTION

In accordance with the principles of the present invention, a self-leveling eating utensil which is easy to manufacture, use, and clean is provided. The eating utensil includes a handle and a food carrier portion, such as a spoon bowl or fork tines, extending from the handle. The food carrier portion is provided at one end of a shank which serves to couple the food carrier portion and handle together. The shank is rotatably coupled to the handle and the food carrier portion is positioned with respect to the shank to be weighted into an appropriate position and orientation for carrying food to an individual's mouth.

Preferably, an additional weight is provided on the shank to enhance the weighting of the shank into the food carrying position and orientation. Most preferably, the weight is formed as a bent portion of the free end of the shank opposite the end at which the food carrier portion is provided. The weight further functions to lock the shank with respect to the handle to prevent accidental detachment therefrom, while permitting relative rotation therebetween.

In addition, the handle of the eating utensil of the present invention may be formed to facilitate assembly and manufacture of the eating utensil as well as to permit easy cleaning thereof. In a preferred embodiment, the handle is formed from two handle halves, each half having a channel for receiving the eating utensil shank to permit rotation of the shank therein. Each half preferably is further formed to interlock at at least one end (without the requirement of a separate element to effect locking of such ends of the handle halves). The handle halves may be snap fit together at intervals between the first and second ends thereof for easy assembly and disassembly. Alternatively, the other ends of the handle halves may be coupled together by a separate coupling element coupled thereto to hold the ends together. Thus, if the coupling element is used, the complete handle includes only three parts—a first half, a second half, and a coupling element. If the halves are coupled together without a coupling element, then handle is formed of only two parts which are removably coupled together. As will be appreciated, such simple configuration of the handle not only facilitates assembly but also facilitates disassembly and reassembly for purposes of cleaning the eating utensil.

These and other features and advantages of the present invention will be readily apparent from the following detailed description of the invention, the scope of the invention being set out in the appended claims.

BRIEF DESCRIPTION OF THE DRAWINGS

The detailed description will be better understood in conjunction with the accompanying drawings, wherein like reference characters represent like elements, as follows.

DETAILED DESCRIPTION OF THE INVENTION

Figure 1:
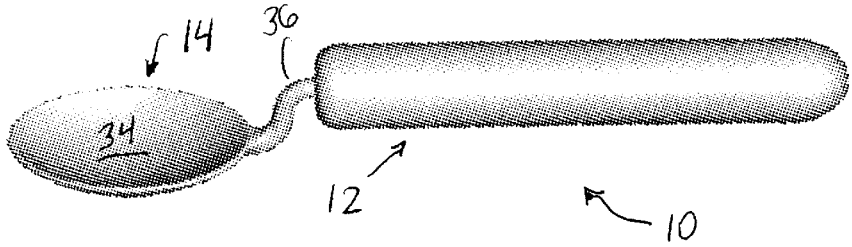
FIG. 1 is a perspective view of a self-leveling eating utensil formed in accordance with the principles of the present invention.
Figure 2:
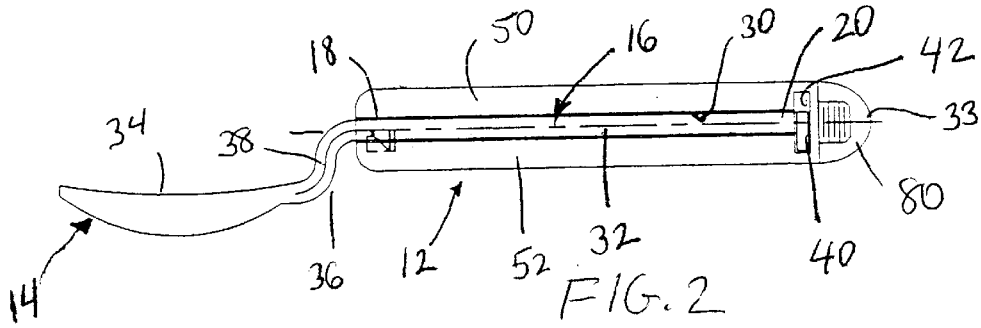
FIG. 2 is a side elevational view, partially in cross-section, of the self-leveling eating utensil of FIG. 1.

A self-leveling eating utensil 10 formed in accordance with the principles of the present invention is illustrated in FIG. 1. As may be appreciated, eating utensil 10 includes a handle 12 and a food carrier 14 coupled to handle 12 via shank 16, as shown in FIG. 2. Food carrier 14 may be in any form capable of carrying food (including solid, semi-solid, and liquid foods) to the mouth of an individual, such as a spoon bowl or fork tines. Shank 16 has a first end 18, to which food carrier 14 is coupled, and a second end 20 coupled to, and preferably within, handle 12. Food carrier 14 may be integrally formed from first end 18 of shank 16 or may be formed as a separate element subsequently coupled (either removably or permanently) to first end 18. If food carrier 14 is provided as a separate element removably coupled to shank 16, interchangeable food carriers may be provided to permit interchanging with different types of food carriers as desired. If desired, a rubberized coating may be provided over handle 12 or handle 12 may be otherwise configured (e.g., provided with a textured surface) to enhance gripping.

Figure 3:
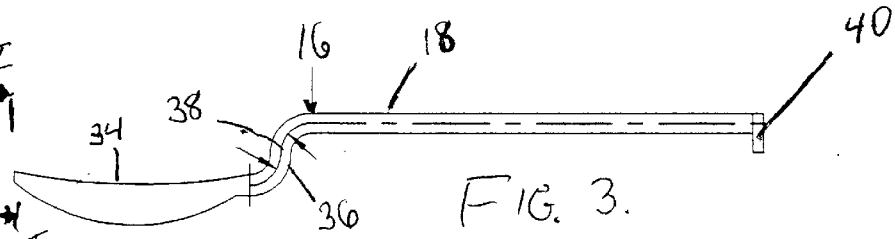
FIG. 3 is a side elevational view of the shank and food carrier portion of the self-leveling eating utensil of FIG. 2.

In accordance with the principles of the present invention, shank 16 is rotatably positioned within recess 30 of handle 12 via handle-coupling portion 32 of shank 16. As may be appreciated with reference to FIG. 3, showing shank 16 and food carrier 14 in isolation, handle-coupling portion 32 preferably is an elongated portion of shank 16 which permits secure connection to handle 12 while still being capable of rotating within recess 30 of handle 12. In a preferred embodiment, recess 30 and handle-coupling portion 32 each have substantially circular cross-sections, the diameter of the recess cross-section being sufficiently larger than the diameter of the handle-coupling portion cross-section to permit free rotation of handle-coupling portion 32 within recess 30. Handle-coupling portion 32 preferably is substantially straight along most of its longitudinal extent so that handle-coupling portion 32 fits within a correspondingly shaped recess 30 within handle 12 without requiring recess 30 to be configured to accommodate bent portions as shank 16 rotates within handle 12.

As may be appreciated with reference to FIGS. 1–3, food carrier 14 is downwardly offset from longitudinal axis 33 of handle-coupling portion 32 of shank 16. Moreover, food carrier 14 preferably has a center of gravity and mass such that food carrier 14 weights itself down to a position below shank 16. Thus, food carrier 14 tends to cause shank 16 to rotate such that food carrier 14 remains below handle 12 in a self-leveling position and orientation. Thus, food-carrying surface 34 of eating utensil 10 is always level and oriented to support and carry food without spilling or dropping the food.

In addition to permitting self-leveling, the configuration of food carrier 14 with respect to handle 12 preferably also facilitates feeding. Because individuals with limited manual dexterity may not be capable of readily positioning food carrier 14 at the proper position for delivering food on food carrier 14 to his/her mouth, food carrier 14 is preferably positioned with respect to handle 12 to make self-feeding with eating utensil 10 as easy as possible. In particular, manually impaired individuals may not be capable of adequately bending their wrist. Also, babies typically do not bend their wrist during self-feeding. Without the added movement of bending the wrist, manipulation of an eating utensil to position the food carrier portion thereof at the proper position to deliver food to the mouth, self-feeding becomes a difficult task. Thus, food carrier 14 preferably is positioned with respect to handle 12 (preferably below handle 12) such that during self-feeding, the gross manual movements of bending the arm solely at the elbow to bring eating utensil 10 close to the mouth will nonetheless result in food carrier 14 reaching the individual's mouth to deliver food thereto. Thus, the lack of fine motor coordination which necessitates only gross movements does not impede an individual's capacity to feed himself or herself.

Moreover, food carrier 14 and handle-coupling portion 32 are preferably positioned with respect to each other to permit a care giver to feed an individual with eating-utensil 10 without handle 12 obstructing the care giver's view of both food carrier 14 and the individual's mouth. Thus, the positioning of food carrier 14 below handle 12, which facilitates self-leveling of eating utensil 10 as well as self-feeding with eating utensil 10, also assists a care giver in feeding an individual.

In order to position food carrier 14 below shank 16, to result in the above-described benefits, shank 16 has a bent transition portion 36 between food carrier 14 and handle-coupling portion 32. Transition portion 36 is bent to a sufficient extent to permit at least one of the above-described benefits of having food carrier 14 below handle 12. As shown in FIGS. 2 and 3, the central portion 38 of transition portion 36 preferably is perpendicular, or at least close to perpendicular, to longitudinal axis 33 of handle-coupling portion 32 of shank 16 as well as to the food-carrying surface 34 of food carrier 14. Such configuration permits food carrier 14 to be as close to handle 12 as possible, thereby facilitating rotation of shank 16 during self-leveling as well as simplifying manufacture. A drastic transition, such as the provision of a substantially perpendicular transition portion 36, has been found to permit the most responsive leveling of food carrier 14 without hesitation of rotation of shank 16. However, other configurations which result in at least one of the above-described benefits of having food carrier 14 below handle 12, may also be practiced in accordance with the present invention. Preferably, transition portion 36 is curved at its transition to both handle-coupling portion 32 and food carrier 14 so that there are no sharp edges formed by such bend.

In addition to having food carrier 14 be offset from handle-coupling portion 32 to cause food carrier 14 of eating utensil 10 to be self-leveling, shank 16 preferably also includes a weight 40 to further facilitate self-leveling of food carrier 14. Weight 40 preferably is provided at second end 20 of shank 16 (a free end of shank 16 opposite food carrier 14). Such position of weight 40 provides optimal balancing of the weight of food carrier 14 so that shank 16 may freely rotate within handle 12 without sticking (a problem common to the prior art self-leveling eating utensils discussed above). Moreover, such position of weight 40 permits weight 40 to be formed as an integral portion of handle-coupling portion 32. For example, weight 40 may be formed by bending free second end 20 of shank 16 in the direction in which food carrier 14 is offset. Thus, weight 40 contributes to the weighting caused by food carrier 14. Of course, it will be appreciated that weight 40 may be positioned along shank 16 at a position other than at second end 20 and may be formed as an integral portion of shank 16 at such other position. It will be further appreciated that weight 40 can be an element separate from shank 16 and coupled thereto, at any desired point, either permanently or removably (such as to permit adjustment of the position of weight 40 as desired).

Weight 40 may also function to couple shank 16 to handle 12. Specifically, weight 40 preferably is offset from longitudinal axis 33 of handle-coupling portion 32 of shank 16. However, recess 30 of handle 12 preferably is formed to conform substantially to the shape of handle-coupling portion 32. A separate weight-receiving recess 42 is provided to accommodate weight 40 in a position offset from longitudinal axis 33 as well as the remainder of recess 30 of handle 12. Thus, although handle-coupling portion 32 of shank 16 is freely rotatable about longitudinal axis 33 thereof within recess 30 of handle 12, handle-coupling portion 32 is prevented from moving longitudinally along axis 33 because the positioning of weight 40 in weight-receiving recess 42 longitudinally locks shank 16 with respect to handle 12.

Figure 4:
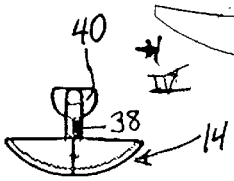
FIG. 4 is an end view along line IV—IV of FIG. 3.

If free second end 20 of handle-coupling portion 16 is rounded, and weight 40 is formed by bending second end 20 in the direction of food carrier 14, weight 40 will have a half-moon shape, as illustrated in FIG. 4. Such half-moon shape permits the formation of a substantially annular weight-receiving recess 42 which substantially conforms to the outer contour of weight 40 and thus requires the minimal amount of space to accommodate weight 40 and to permit rotation thereof. Moreover, a weight-receiving recess 42 configured to receive a half-moon shaped weight, which rotates about longitudinal axis 33 as shank 16 rotates, may be uniformly dimensioned and configured without needing to accommodate any particular discontinuities or asymmetric shapes.

Turning now to FIGS. 5–8, in accordance with another aspect of the present invention, handle 12 is preferably formed to permit easy cleaning of recess 30 therein. Moreover, handle 12 is also preferably formed to permit easy assembly, disassembly, and reassembly. As shown in FIGS. 5–8, handle 12 preferably is formed from a first handle half 50 and a second handle half 52 configured to permit ready coupling together for assembly as well as decoupling for cleaning. The interior of each handle half 50, 52 defines a portion of recess 30 for receiving handle-coupling portion 32 of shank 16. As described above, recess 30 preferably is circular to facilitate rotation of handle-coupling portion 32 therein. Thus, in the embodiment of FIGS. 7 and 8, each handle half 50, 52 has a longitudinal recess 54*a*, 54*b* with a semi-circular cross-section. Moreover, each half 50, 52 preferably defines at least a portion 56*a*, 56*b* of weight-receiving recess 42. Handles 50, 52 preferably are removably coupled together to permit access to recesses 54*a*, 54*b*, 56*a*, and 56*b* to permit ready cleaning thereof.

Figure 7:
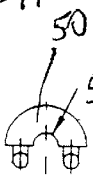
FIG. 7 is an end view along line VII—VII of the first handle half of FIG. 5.
Figure 5:
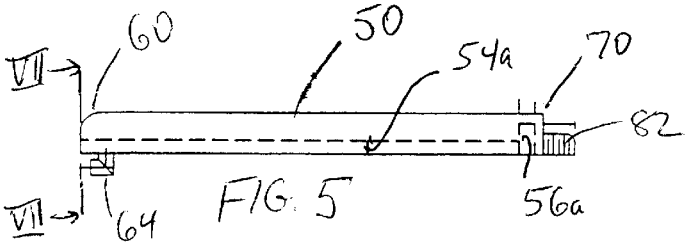
FIG. 5 is a side elevational view of a first half of the handle of the self-leveling eating utensil of FIG. 2.
Figure 8:
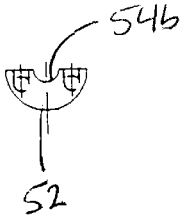
FIG. 8 is a cross-sectional view along line VIII—VIII of the second handle half of FIG. 6.

First and second handle halves 50, 52 may be identical and formed in the same mold. However, to facilitate coupling together of first and second handle halves in a readily removable manner (such that handle 12 may be readily assembled, to facilitate manufacturing, and disassembled and reassembled, to facilitate cleaning), at least one end 60 of first handle half 50 is formed to interlock with a corresponding end 62 of second handle half 52 without the need for a separate coupling element. For instance, first handle half 50 may be provided with a projection and second handle half 52 may be provided with a recess shaped to receive the projection on first handle half 50. Such projection and corresponding recess may be formed in any manner, and most preferably are configured to facilitate assembly and disassembly. As shown in FIG. 5, first handle half 50 is provided with an L-shaped projection 64 and second handle half 52 is provided with a corresponding recess 66 shaped to receive projection 64. Since the walls of handle halves 50, 52 which are coupled together straddle recess 30 (such as formed by longitudinal recesses 54*a*, 54*b* of handle halves 50, 52, respectively), preferably two projections 64 and corresponding recesses 66 are provided, as shown in FIGS. 7 and 8, to straddle recess 30 formed by handle halves 50, 52 when assembled and coupled together.

If desired, both handle halves 50, 52 may be formed to be removably coupled together, such as by a snap fit. For instance, a projection and corresponding recess may be provided at second ends 70, 72 of handle halves 50, 52, respectively. Additional projections and corresponding recesses may be provided along handle halves 50, 52 between first ends 60, 62 and second ends 70, 72. Alternatively, a separate coupling element may be provided to couple together second ends 70, 72 of handle halves 50, 52, respectively. If a separate coupling element is used, projections and recesses in addition to projection 64 and recess 66 are optional.

Figure 6:
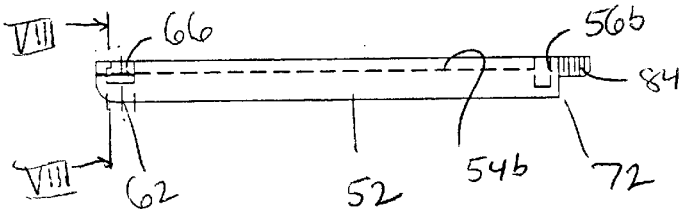
FIG. 6 is a side elevational view of a second half of the handle of the self-leveling eating utensil of FIG. 2.
Figure 1:
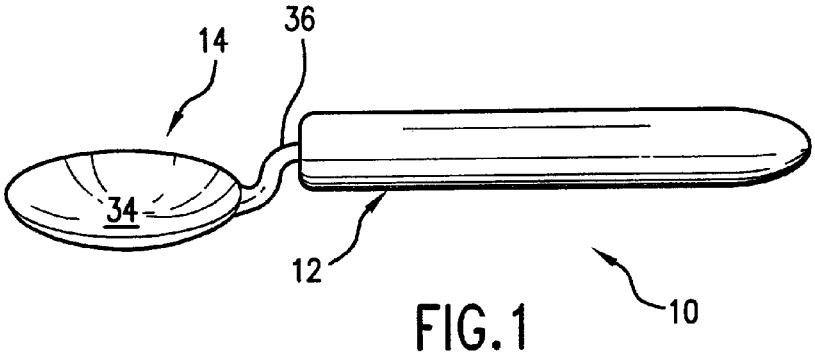
Figure 2:
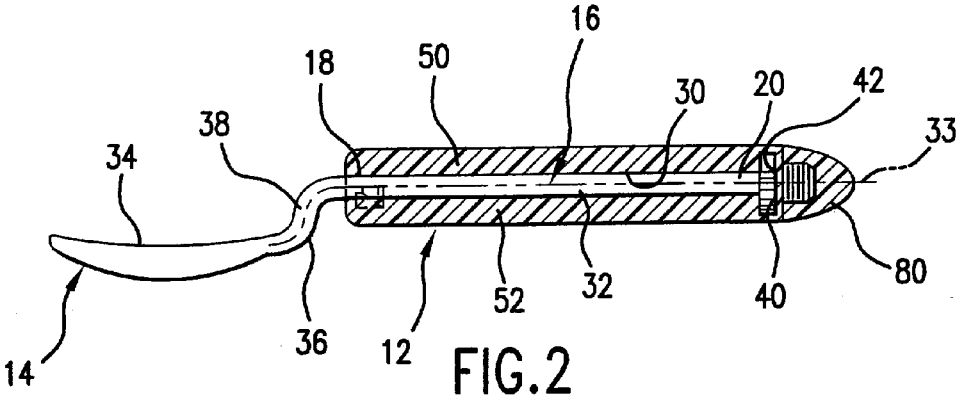
Figure 3:
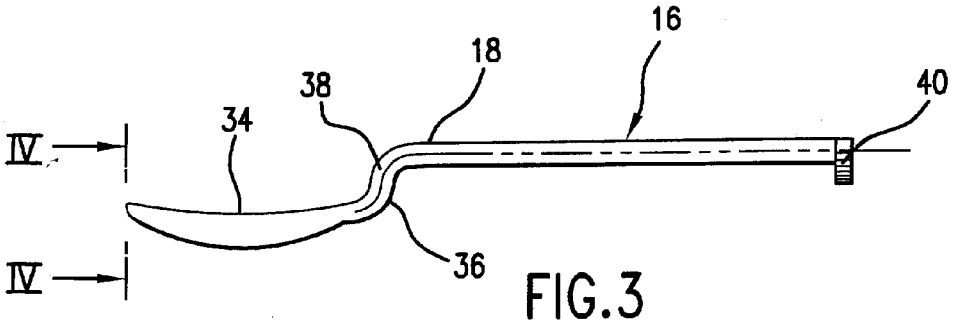
Figure 4:
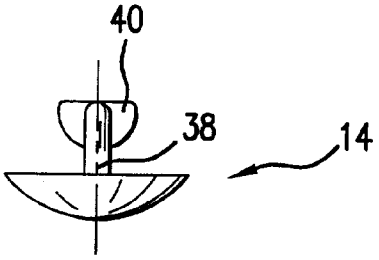
Figure 7:
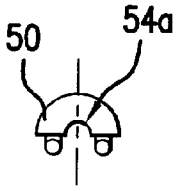
Figure 5:
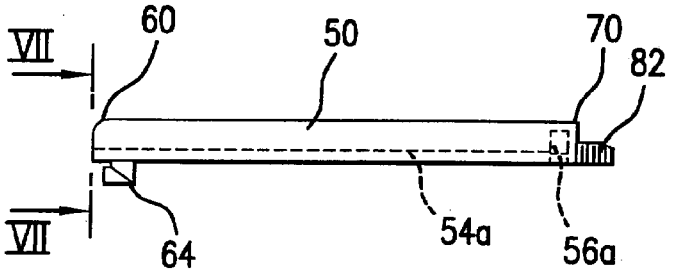
Figure 8:
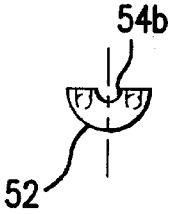
Figure 6:
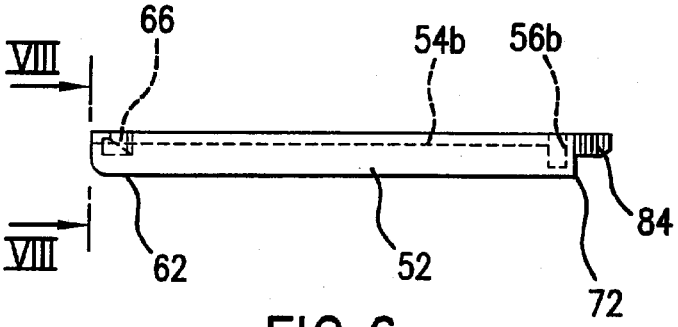

The coupling element may be in any desired form or configuration to facilitate easy coupling together of handle halves 50, 52 and also to facilitate repeated removal and replacement to decouple and recouple handle halves 50, 52 for cleaning, as described above. For instance, the coupling element may be configured to be placed over second ends 70, 72 of handle halves 50, 52. In the embodiment of FIGS. 2, 5, and 6, the coupling element is in the form of an end cap 80 removably coupled to second ends 70, 72 of handle halves 50, 52. Preferably, to facilitate removability, as well as to provide a secure coupling of end cap 80 to handle halves 50, 52, end cap 80 is internally threaded to engage with corresponding threadings 82, 84 on second ends 70, 72. Most preferably, as may be appreciated with reference to FIG. 2, second ends 70, 72 are reduced in diameter and the diameter of end cap 80 is substantially equal to the diameter of handle 12 such that once end cap 80 is coupled to second ends 70, 72 handle 12 has a smooth exterior without discontinuities at the juncture of end cap 80 and the remainder of handle halves 50, 52.

As may be appreciated, application of the principles of the present invention results in an eating utensil 10 which is simple to manufacture, assemble, disassemble, and reassemble. For instance, the formation of weight 40 by bending second end 20 of shank 16 not only is a simple manner of manufacturing a weighted shank but also provides a simple manner of permitting the shank to be rotatably coupled within handle 12 without inadvertently separating therefrom. Moreover, the formation of handle 12 from two handle halves 50, 52 not only permits simple assembly during manufacture but also permits simple disassembly for cleaning handle 12 and reassembly for continued use after cleaning.

The materials of the components of eating utensil 10 are also preferably selected to simplify manufacture yet to permit extended use. For example, the components of eating utensil 10 may be formed from plastics approved by the FDA for formation of eating utensils (particularly for babies) or from metals such as stainless steel. Preferably, the materials are readily formed into the necessary configurations for the formation of the components of eating utensil 10. Moreover, the materials preferably are capable of being sterilized.

It will be appreciated features described with respect to one embodiment typically may be applied to another embodiment, whether or not explicitly indicated. The various features described herein may be used singly or in any combination thereof. Therefore, the present invention is not limited to only the embodiments specifically described herein.

While the foregoing description and drawings represent the preferred embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, and with other elements, materials, and components, without departing from the spirit or essential characteristics thereof. For example, the recess which accommodates the eating utensil shank need not be circular, as described herein, but may have any other cross-sectional shape. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims, and not limited to the foregoing description.

What is claimed is:

1. A self-leveling eating utensil comprising:

a first handle half having a first end, a second end, and a first recess;

a second handle half having a first end, a second end, and a second recess;

a shank having a longitudinal axis, a handle-coupling portion, a first end, and a second end; and a food carrier having a food-carrying surface;

wherein:

said first handle half is shaped and configured for removable coupling to said second handle half with said first end of said first handle half coupled to said first end of said second handle half and said second end of said first handle half coupled to said second end of said second handle half to permit decoupling for cleaning said first and second recesses and to permit recoupling with said first end of said first handle half coupled to said first end of said second handle half and said second end of said first handle half coupled to said second end of said second handle half to permit continued use of said eating utensil;

said handle-coupling portion of said shank is rotatably coupled within said first and second recesses of said first and second handle halves such that said handle-coupling portion of said shank always freely rotates within said handle without sticking; and said food carrier is coupled to said first end of said shank to be offset from said shank longitudinal axis to weight said food carrier into a self-leveling position with said food-carrying surface positioned to carry food without spillage.

2. A self-leveling eating utensil as in claim 1, wherein:

a lug extends from said first end of said first handle half; and a recess is defined in said first end of said second handle half shaped to receive said lug.

3. A self-leveling eating utensil as in claim 2, wherein said second ends of said first and second handle halves include exterior threadings, said self-leveling eating utensil further including an end cap internally threaded to engage said exterior threadings on said second ends of said first and second handle halves, whereby said first and second handle halves are coupled together by inserting said lug into said recess at said first ends of said first and second handle halves and by threading said end cap over said second ends of said first and second handle halves.

4. A self-leveling eating utensil as in claim 2, wherein said lug is L-shaped.

5. A self-leveling eating utensil as in claim 1, further comprising a weight coupled to said handle-coupling portion of said shank to further weight said food carrier into the self-leveling position.

6. A self-leveling eating utensil as in claim 5, wherein a weight-receiving recess is formed in each of said first and second handle halves, said weight being rotatably received within said weight-receiving recesses when said first and second handle halves are coupled together with said handle-coupling portion freely rotatably coupled within said first and second recesses of said first and second handle halves.

7. A self-leveling eating utensil as in claim 1, further comprising only one coupling element configured to couple said first and second handle halves together.

8. A self-leveling eating utensil comprising:

a handle having first and second ends;

a shank rotatably coupled to said handle and having a longitudinal axis, a first end, and a second end;

a food carrier having a food-carrying surface and being coupled to said first end of said shank to be offset from said shank longitudinal axis in a first direction to weight said food carrier into a self-leveling position with said food-carrying surface positioned to carry food without spillage; and a weight on said shank offset from said shank longitudinal axis in only said first direction to weight said shank into a position in which said food carrier is self-leveling;

wherein:

a weight-receiving recess is defined in said handle between said first and second ends of said handle to always permit free rotation of said weight therein without sticking; and said handle has a substantially uniform outer diameter between said first and second ends and does not increase in diameter to accommodate said weight-receiving recess.

9. A self-leveling eating utensil as in claim 8, wherein said weight is formed by bending said second end of said shank in the direction of said food carrier.

10. A self-leveling eating utensil as in claim 8, wherein said food carrier is coupled to said shank via a transition portion having a central portion perpendicular to said shank longitudinal axis.

11. A self-leveling eating utensil as in claim 10, wherein said weight is coupled to said second end of said shank.

12. A self-leveling eating utensil as in claim 9, wherein said second end of said shank is rounded such that said weight, formed by bending said second end of said shank, is half-moon shaped.

13. A self-leveling eating utensil as in claim 10, wherein said transition portion is bent with respect to said shank longitudinal axis.

14. A self-leveling eating utensil as in claim 8, wherein said food-carrying surface is parallel to said shank longitudinal axis.

15. A self-leveling eating utensil as in claim 8, wherein:

an interior recess is defined within said handle; and said shank has a handle-coupling portion rotatably positioned within said handle recess.

16. A self-leveling eating utensil as in claim 15, wherein said handle recess includes a weight-receiving recess offset from said handle recess and shaped to receive said weight and to permit said weight to rotate therein.

17. A self-leveling eating utensil as in claim 8, wherein said food carrier is in the shape of a spoon bowl.

* * * * *

UNITED STATES PATENT AND TRADEMARK OFFICE

CERTIFICATE OF CORRECTION

PATENT NO. : 6,393,704 B1
DATED : May 28, 2002
INVENTOR(S) : David Tompkins et al.

It is certified that error appears in the above-identified patent and that said Letters Patent is hereby corrected as shown below:

Title page,
The Title page should be deleted and substitute therefore the attached Title page.

Drawings,
Delete Drawing sheets 1-2 and substitute therefore the Drawing sheets, consisting of Fig. 1-6.

Signed and Sealed this

Seventh Day of January, 2003

JAMES E. ROGAN
*Director of the United States Patent and Trademark Office*

(12) United States Patent
Tompkins et al.

(10) Patent No.: US 6,393,704 B1
(45) Date of Patent: May 28, 2002

(54) SELF-LEVELING EATING UTENSIL

(76) Inventors: David Tompkins, 1700 Dale St., Morgan City, LA (US) 70380; Gerard D. Byrne, Jr., 514 Tournament Ave., Berwick, LA (US) 70342

( * ) Notice: Subject to any disclaimer, the term of this patent is extended or adjusted under 35 U.S.C. 154(b) by 0 days.

(21) Appl. No.: 09/564,676

(22) Filed: May 4, 2000

(51) Int. Cl.[7] ..... A47G 21/04; A47J 43/28
(52) U.S. Cl. ..... 30/324; 30/342; 30/340
(58) Field of Search ..... 30/324, 340, 322, 30/342, 344; 16/DIG. 18, DIG. 19; D7/653

(56) References Cited

U.S. PATENT DOCUMENTS

| | | | | | |
|---|---|---|---|---|---|
| 1,128,190 | A | * | 2/1915 | Routery | 30/327 |
| 1,347,307 | A | * | 7/1920 | Thomas | 30/1 |
| 1,354,709 | A | * | 10/1920 | Williams | 30/169 |
| D90,906 | S | * | 10/1933 | Baker, Jr. | 30/327 |
| 1,997,131 | A | | 4/1935 | Champlin | 30/9 |
| 2,503,643 | A | * | 4/1950 | Verbrugge | |
| 2,571,264 | A | | 10/1951 | Legarra | 259/144 |
| 2,636,266 | A | | 4/1953 | Sweet | 30/324 |
| 2,682,705 | A | * | 7/1954 | Johnson | |
| 2,724,894 | A | * | 11/1955 | Tour | 30/324 |
| 2,741,027 | A | * | 4/1956 | Margolin | |
| 2,809,426 | A | | 10/1957 | Pickering | 30/324 |
| 3,259,132 | A | | 7/1966 | Katter | 128/344 |
| 3,266,081 | A | | 8/1966 | Heim | 16/110 |
| 4,028,803 | A | * | 6/1977 | Currie | |
| 4,389,777 | A | | 6/1983 | Landsberger | 30/324 |
| 4,877,609 | A | * | 10/1989 | Beck et al. | 206/525 |
| 4,993,156 | A | | 2/1991 | Craven | 30/142 |
| 5,603,163 | A | | 2/1997 | Ikner, Jr. | 30/324 |
| 5,890,223 | A | | 4/1999 | Klemmer | 30/150 |
| 6,145,204 | A | * | 11/2000 | Cash | 30/322 |

FOREIGN PATENT DOCUMENTS

| | | | |
|---|---|---|---|
| DE | 2005 351 | | 8/1971 |
| GB | 833889 | | 5/1960 |
| GB | 2214059 | * | 8/1989 |

* cited by examiner

*Primary Examiner*—Allan N Shoap
*Assistant Examiner*—Thomas J. Druan, Jr.
(74) *Attorney, Agent, or Firm*—Pennie & Edmonds LLP

(57) ABSTRACT

A self-leveling eating utensil having a handle and a food carrier rotatably coupled to the handle. The food carrier may be coupled to a shank which is, in turn, rotatably coupled to the handle. The food carrier is positioned offset from the handle and the shank to weight itself into a self-leveling position with the food-carrying surface thereof positioned to carry food without spillage. A weight is preferably provided on the shank to further weight the food carrier into the self-leveling position. The weight may be formed at the free end of the shank opposite the food carrier. In a preferred embodiment, the weight is formed as a bend in the free end of the shank in a direction toward the food carrier. Preferably, the handle is formed to permit decoupling to clean the interior thereof and recoupling to use the eating utensil once again after cleaning. Such handle is formed from first and second handle halves which are readily coupled, decoupled, and recoupled. In a preferred embodiment, the handle halves are directly coupled together at at least first ends which engage each other directly for coupling together. The second ends of the handle halves may be coupled together either directly or with the assistance of a separate coupling element, such as an end cap fitted over the second ends.

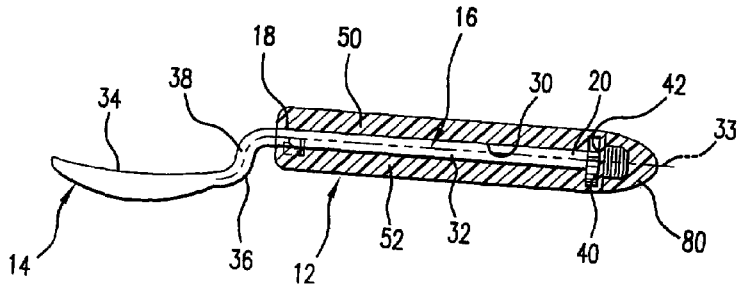

17 Claims, 1 Drawing Sheet